United States Patent [19]

Hogue et al.

[11] 4,303,971

[45] Dec. 1, 1981

[54] LUMINAIRE

[75] Inventors: Marcus P. Hogue, Hendersonville; Gregory A. Frisbee, East Flat Rock, both of N.C.

[73] Assignee: General Electric Company, Schenectady, N.Y.

[21] Appl. No.: 88,951

[22] Filed: Oct. 29, 1979

[51] Int. Cl.[3] ..... F21V 7/00

[52] U.S. Cl. ..... 362/297; 362/305; 362/346

[58] Field of Search ..... 362/297, 346, 347, 304, 362/305, 263

[56] References Cited

U.S. PATENT DOCUMENTS

| | | | |
|---|---|---|---|
| 3,588,493 | 6/1971 | Nordquist | 240/41.37 |
| 3,944,810 | 3/1976 | Grindle | 362/297 |
| 4,066,887 | 1/1978 | Levis | 362/341 |
| 4,208,704 | 6/1980 | Draper | 362/297 |

*Primary Examiner*—Donald P. Walsh

*Attorney, Agent, or Firm*—Lawrence R. Kempton; Philip L. Schlamp

[57] ABSTRACT

Luminaire for illuminating stacked material along warehouse aisles. The luminaire comprises a high intensity discharge lamp mounted vertically in a reflector having a somewhat flattened bell shape and formed of four reflector segments of somewhat trapezoidal shape arranged symmetrically about the light source, each reflector segment being parabolic in vertical section and elliptical in horizontal section.

12 Claims, 5 Drawing Figures

AISLE

LUMINAIRE

The present invention relates to luminaires, and particularly to luminaires for illuminating stacked material along warehouse aisles or the like.

It is an object of the invention to provide an improved luminaire for lighting stacked material arranged along warehouse aisles.

It is another object of the invention to provide a luminaire of the above type for lighting the stacked material in four quadrants in the vicinity of the luminaire with relatively uniform light distribution.

Another object of the invention is to provide a luminaire of the above type having a reflector for producing the desired light distribution without the need for a light refractor.

Still another object of the invention is to provide a luminaire of the above type which avoids producing glare in the eyes of an operator engaged in moving the stacked material in the vicinity of the luminaire.

Other objects and advantages will become apparent from the following description and the appended claims.

With the above objects in view, the present invention in one of its aspects relates to a luminaire comprising, in combination, a generally dome-shaped reflector having a wall extending about an axis and defining a bottom opening, and a lamp mounted in the reflector extending substantially along the axis, the reflector adapted to be mounted with its axis vertical above a warehouse aisle or the like for illuminating stacked material along both sides of the aisle, the reflector wall comprising four reflector sections arranged about the axis for directing light from the lamp downwardly and outwardly through the bottom opening in two pairs of divergent light beams on opposite sides of the luminaire for illuminating four different areas of the stacked material on opposite sides of the warehouse aisle.

The invention will be better understood from the following description taken in conjunction with the accompanying drawings, in which.

Figure 1:
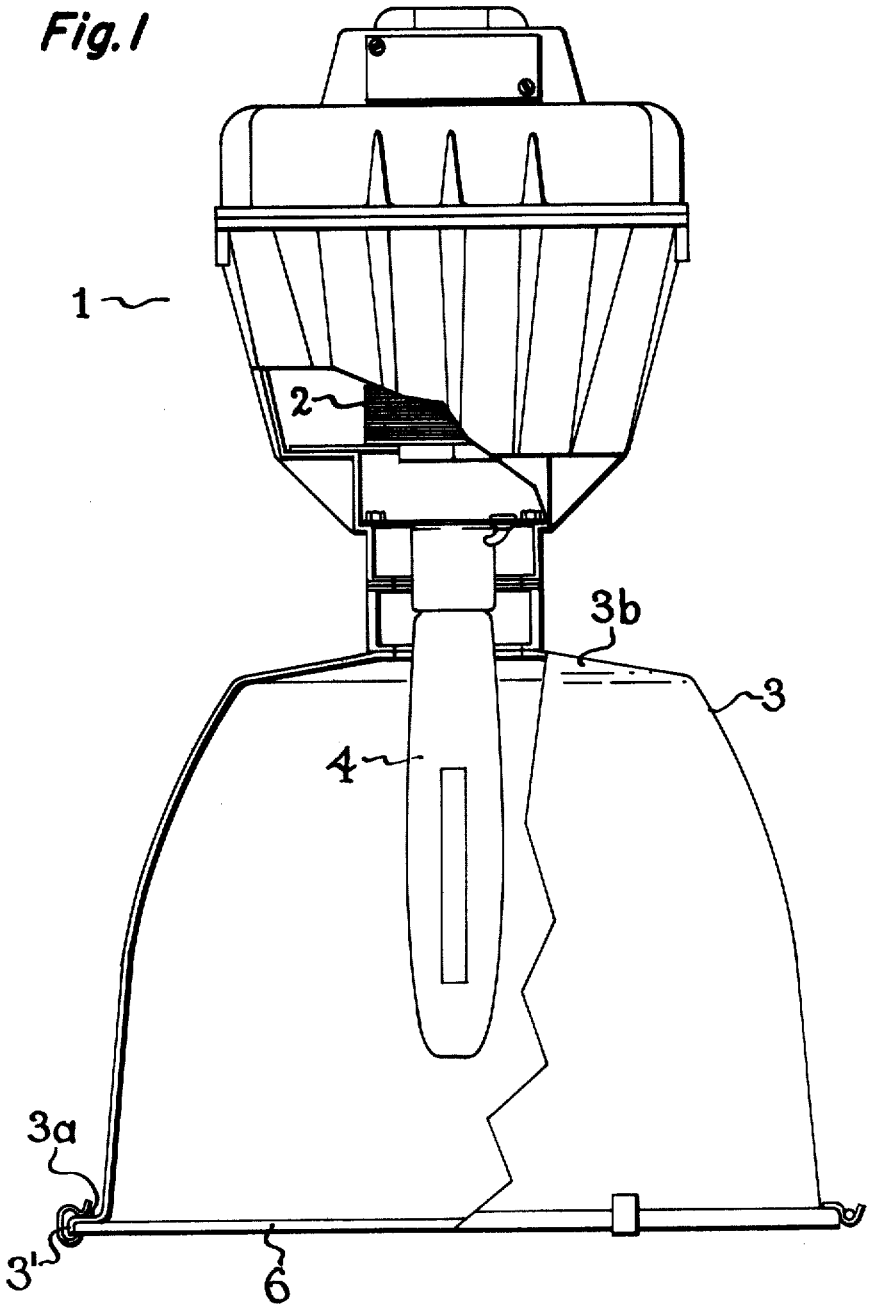
FIG. 1 is an elevational view, partly broken away, of a luminaire embodying the invention.

Referring now to the drawings, and particularly to FIG. 1, there is shown a luminaire of a type adapted to be mounted above a warehouse aisle for illuminating stacked material along the aisle in accordance with the invention, the luminaire comprising a ballast housing 1, which contains electrical ballast components such as transformer 2, and from which is suspended a generally dome-shaped reflector 3 constructed in accordance with the invention. Mounted within reflector 3 is lamp 4 which is typically a high intensity gaseous discharge lamp such as a sodium vapor, mercury, or metal halide lamp. The luminaire is normally mounted above the floor of the warehouse aisle midway between the sides of the aisle, with the bottom opening of reflector 3 facing downwardly and lamp 4 extending along the vertical axis of reflector 3, and with the longer lateral axis of the reflector extending across the aisle (see FIGS. 2 and 5). Lamp 4 is suitable electrically connected to the ballast components in ballast housing 1 for operation thereby.

Figure 2:
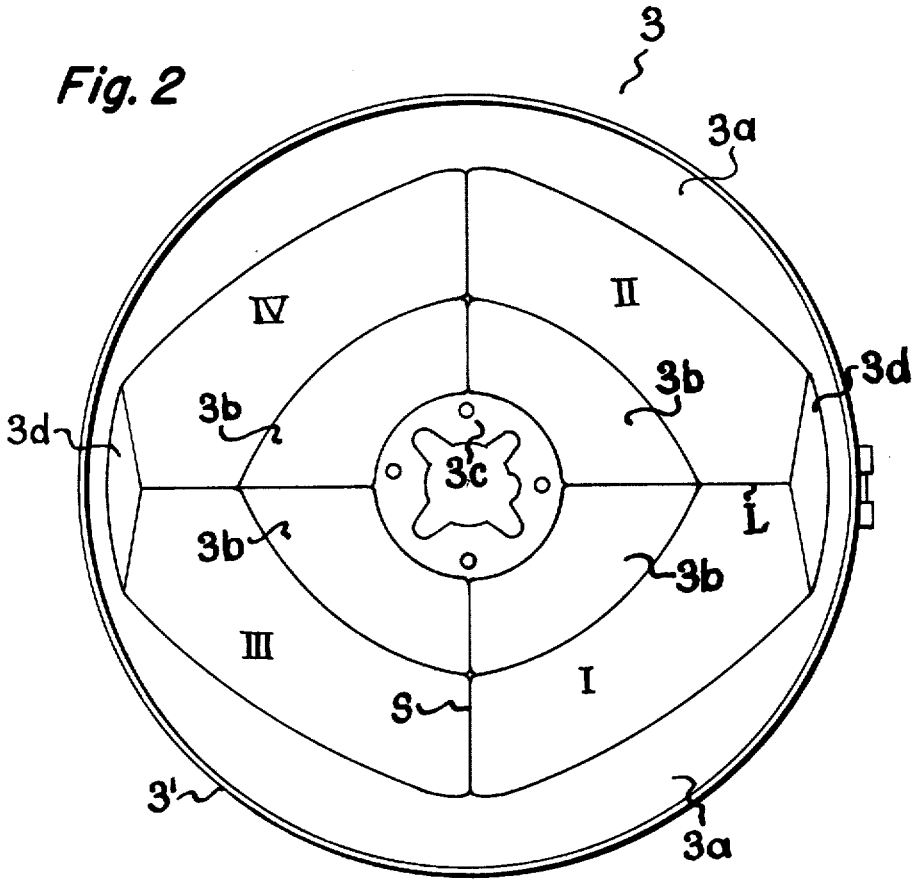
FIG. 2 is a bottom plan view of the FIG. 1 luminaire.

As seen in the bottom plan view of FIG. 2, the principal reflective portion of reflector 3 comprises four curved segments (also referred to herein as reflector quadrants) designated I, II, III and IV. The form and arrangement of the reflector quadrants are such that the reflector in this region is generally ovate in horizontal section, with adjoining reflector quadrants II and IV arranged on the side of the longer transverse axis L opposite that of adjoining reflector quadrants I and III, and reflector quadrants I and II and reflector quadrants III and IV are arranged on opposite sides of the shorter transverse axis S. As will be noted from FIG. 2, the reflector is to be mounted in the aisle with long axis L extending normal to the direction of the aisle while short axis S extends along the direction of the aisle.

Figure 3:
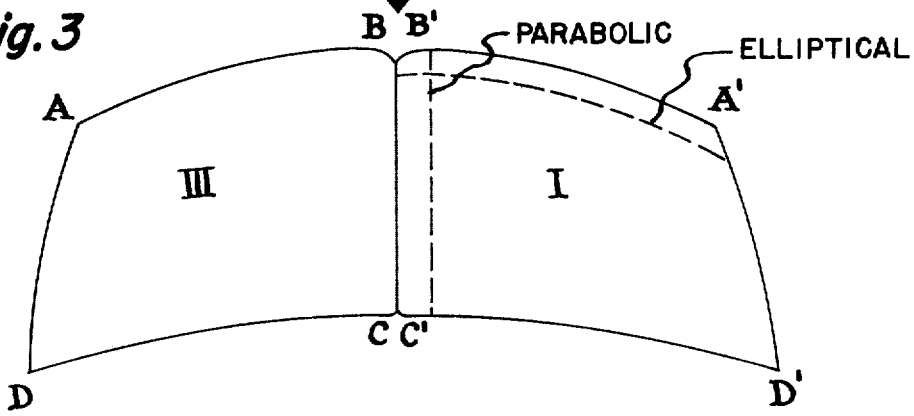
FIG. 3 is an interior elevational view of a portion of the luminaire reflector.

The form of the reflector quadrants is such, as seen in FIG. 3, that they would be substantially trapezoidal in shape if pressed flat. Adjoining reflector quadrants I and III shown in FIG. 3, as well as the opposite pair of adjoining reflector quadrants II and IV, are smoothly blended at their adjoining sides, as more fully explained below.

At its bottom, reflector 3 is formed with an annular flat portion 3*a* serving as a transition from the bottom edges of the curved reflector segments to a circular periphery, which has a flange 3' for receiving a circular glass cover (lens) 6 should an enclosed sealed unit be desired (see FIG. 1). At its top, reflector 3 is formed with a transition portion 3*b* of shallow conical shape adjoining the top edges of the reflector segments and blending at its top into a concentric, flat annular portion 3*c* extending normal to the vertical axis of the reflector.

At opposite sides of reflector 3 are triangular reflective portions 3*d* which have substantially cylindrical surfaces concentric about the vertical reflector axis and form a transition from the circular reflector quadrants to the annular flat portion 3*a*. Light from the lamp incident on reflector portions 3*d* are redirected thereby onto the stacked material on the opposite side of the aisle, thereby contributing to the uniformity of illumination of the stacked material.

Figure 4:
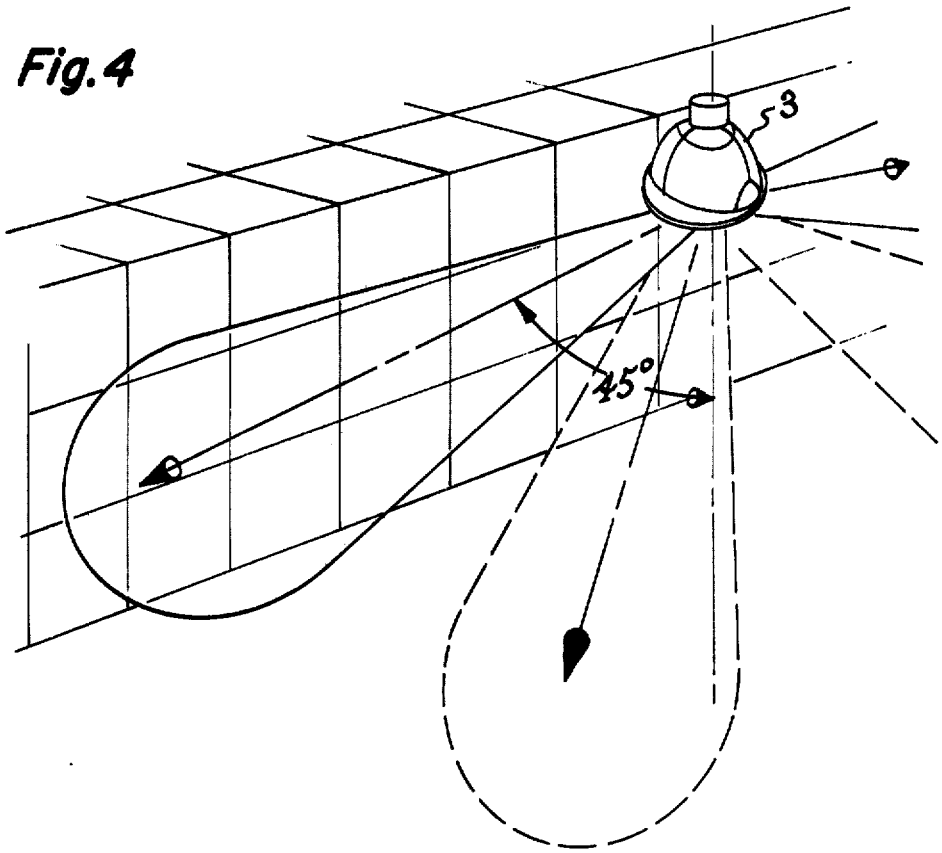
FIG. 4 is a diagrammatic perspective view of the arrangement of the luminaire above a warehouse aisle and the light distribution therefrom.
Figure 5:
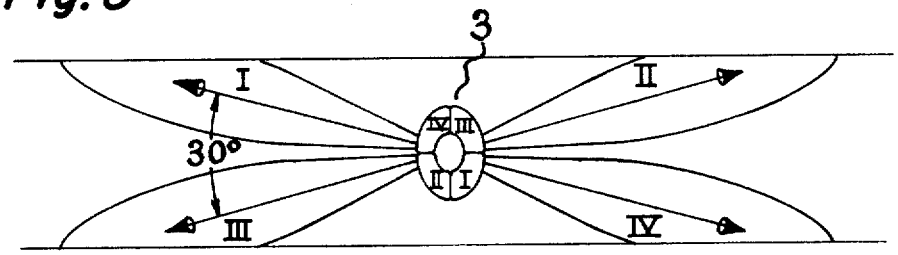
FIG. 5 is a diagrammatic plan view of the luminaire arrangement and light distribution shown in FIG. 4 as viewed from above the luminaire.

The arrangement and form of the four reflector quadrants is such that when the luminaire is mounted above a warehouse aisle along which stacked goods are stored, as shown in FIGS. 4 and 5, the light from lamp 4 is divided into four equal parts with each part directed to the stack substantially from top to bottom. The pattern of the four resulting light beams has the general form of an elongated "X" when viewed from above, as seen in FIG. 5, that is, the light beam pattern comprises two pairs of divergent light beams on opposite sides of the luminaire. Typically, the light beams in each pair diverge at an angle of about 30°, and each beam is directed downwardly at a vertical angle of about 45°,that is, as measured upwardly from the vertical axis. As will be seen from FIGS. 4 and 5, the light beam reflected from each reflector quadrant proceeds, after crossing the light beams reflected from the other reflector quadrants, toward the stack region generally diametrically opposite that reflector quadrant. The respective light beams are designated in FIG. 5 with a numeral corresponding to the numeral of the reflector quadrant from which the beam emanates. The form of the reflector quadrants, as more specifically described below, is such that each quadrant beam illuminates its respective stack region quite uniformly.

In accordance with a preferred embodiment of the invention, reflector quadrants I and IV are substantially identical in shape, and quadrants II and III are substantially identical in shape. Shown in FIG. 3 are adjoining quadrants I and III as viewed along the warehouse aisle in a direction toward the right in the schematic arrangement shown in FIG. 5. The corners of reflector quadrant I, as shown in FIG. 3, are designated A', B', C', D', while the corners of reflector quadrant III are designated A,B,C,D. In the preferred embodiment, all vertical sections of the reflector quadrants are parabolic, and all horizontal sections thereof are elliptical. The focal length of the parabolas in reflector quadrant III progressively increases in parallel sections from side AD toward side BC, while the length of the major and minor axes of the ellipses in quadrant III increase in parallel sections from top AB to bottom CD. While the elliptical major and minor axes in reflector quadrant I similarly increase from top to bottom, the parabolic focal lengths increase from side A'D' to side B'C', so that the adjoining sides BC of quadrant III and B'C' of quadrant I are substantially of the same curvature. It will thus be evident that quadrants I and IV correspond to mirror images of quadrants II and III. Thus, the adjoining sides of the reflector segments are parabolas of the same focal length, providing for the segments to be smoothly joined together.

By way of example, in a typical reflector of the described form, the smallest elliptical section through AB of quadrant III has a major axis length of about 12½ inches and a minor axis length of about 11½ inches. Each subsequent parallel elliptical section toward the bottom increases in minor axis length until the latter is about 19 inches at section CD and the major axis length is about 20½ inches at section CD. The parabola through AD has a focal length of 7¼ inches and all parallel parabolas progressively increase in focal length such that the focal length attains 8¾ inches at BC.

To provide the desired light distribution, all of the parallel ellipses in each reflector quadrant have their major axes lying in a vertical plane which also contains the nearest focus of each ellipse, the light source also being positioned in that plane.

By virtue of the variation in the focal lengths of the parabolic sections as described above, each light beam has a vertical distribution which includes portions directed at vertical angles somewhat above and below the described 45° vertical angle so as to ensure illumination of the upper and lower portions of the stacked material. The described variation in major and minor axis length of the elliptical horizontal sections provides for desired horizontal spreading of the light beam.

While a particular pattern of light distribution has been shown in FIGS. 4 and 5, this distribution characterizes the main beams emanating from the luminaire, and it should be understood that the floor of the aisle will also be illuminated by stray and scattered light rays from the light beams, as well as by light reflected toward the floor from the illuminated stacked material.

As a result of the light distribution pattern provided by the described device, a lift truck operator moving the stacked material in the vicinity of the luminaire would not be subjected to direct glare in the areas directly below the luminaire and up and down the aisle, such as would be produced by other types of lighting fixtures. A further benefit of the invention is that the desired light distribution is achieved simply by a reflector without the need for a light controlling refractor, thus reducing cost, and increasing fixture efficiency.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

We claim:

1. A luminaire comprising, in combination, a generally dome-shaped reflector having a wall extending about an axis and defining a bottom opening, and a lamp mounted in said reflector extending substantially along said axis, said reflector adapted to be mounted with said axis vertical above a warehouse aisle or the like for illuminating stacked material along both sides of the aisle, said reflector wall comprising four reflector portions arranged about said axis for directing light from said lamp downwardly and outwardly through said bottom opening in four light beams respectively distributed in four quadrants about the luminaire for illuminating four different areas of the stacked material on opposite sides of the warehouse aisle.

2. A luminaire as defined in claim 1, said light beams emanating from said reflector in a substantially X - shaped pattern.

3. A luminaire as defined in claim 2, said light beams comprising two pairs of light beams emanating from opposite sides of said reflector, the light beams in each pair diverging about 30° from one another.

4. A luminaire as defined in claim 3, said light beams being principally directed downwardly at a vertical angle of about 45°.

5. A luminaire as defined in claim 1, each said reflector portion being parabolic in vertical section and elliptical in horizontal section.

6. A luminaire as defined in claim 5, said reflector portions arranged in pairs of adjoining portions, the focal lengths of the parabolic vertical sections of the adjoining reflector portions decreasing from their adjoining sides toward the opposite sides thereof.

7. A luminaire as defined in claim 6, the major and minor axes of the elliptical horizontal sections of said reflector quadrants increasing from top to bottom.

8. A luminaire as defined in claim 1, said reflector being generally ovate in horizontal section and defining an elongate axis transverse said first-mentioned axis, said reflector portions being arranged in pairs of adjoining portions on opposite sides of said elongate transverse axis.

9. A luminaire as defined in claim 8, each said reflector portion being parabolic in vertical section and elliptical in horizontal section, the focal length of the parabolic vertical sections of the adjoining reflector portions being substantially equal at their adjoining sides and decreasing toward the opposite sides thereof.

10. A luminaire as defined in claim 8, said reflector having a circular rim defining said bottom opening.

11. A luminaire as defined in claim 1, said lamp being an elongated high intensity gaseous discharge lamp.

12. A luminaire as defined in claim 1, said bottom opening being free of any closure.

* * * * *